United States Patent [19]

DiTullio

[11] 4,449,533

[45] May 22, 1984

[54] BRASSIERE

[75] Inventor: Flavia DiTullio, New York, N.Y.

[73] Assignee: Consolidated Foods Corporation, Winston-Salem, N.C.

[21] Appl. No.: 397,365

[22] Filed: Jul. 12, 1982

[51] Int. Cl.[3] ..... A41C 3/00

[52] U.S. Cl. ..... 128/494; D2/24

[58] Field of Search ..... 128/494, 498, 483, 451, 128/460, 495, 510, 493; D2/24

[56] References Cited

U.S. PATENT DOCUMENTS

| | | | |
|---|---|---|---|
| 1,748,715 | 2/1930 | Imershein . | |
| 2,185,159 | 12/1939 | Rubinstein | D2/24 |
| 2,323,143 | 6/1943 | Loeffel . | |
| 2,455,036 | 11/1948 | Boylan | D2/24 |
| 2,520,836 | 8/1950 | Freedman . | |
| 2,706,816 | 4/1955 | Dozier | 128/460 |
| 3,291,132 | 12/1966 | Puliafico . | |
| 3,817,255 | 6/1974 | Cascio | 128/498 |

FOREIGN PATENT DOCUMENTS

| | | | |
|---|---|---|---|
| 633518 | 12/1949 | United Kingdom | 128/510 |

*Primary Examiner*—Doris L. Troutman

*Attorney, Agent, or Firm*—Charles Y. Lackey; William S. Burden

[57] ABSTRACT

A brassiere wherein left and right bust cups are fashioned from upper and lower fabric panels with the upper panels being connected to a ring element and the lower marginal edges of the cups being connected by an elastic member. Each cup is provided with an elongated petal shaped opening in the upper portion thereof which extends generally upwardly and outwardly a selected distance from the connector element.

7 Claims, 7 Drawing Figures

BRASSIERE

BRIEF SUMMARY AND OBJECTS OF THE INVENTION

The present invention relates to brassieres generally, and particularly to construction of the breast cups and the manner of connecting the cups.

In accordance with a specific embodiment of the present invention, a brassiere is provided with bust cups having lower innermost portions retained in spaced relation by an elastic member which is secured to and extends along the lower marginal edges of the cups. The upper innermost portions of the cups are attached to a ring-like element. Cup contour is achieved by providing darts in the fabric panels.

Petal shaped openings are provided in the cups. Selected darts in the cups may be clipped away resulting in severed edges which define elongated openings in the cups. The innermost edges of the cup fabric on opposite sides of the openings are looped through the ring-like element and stitched.

One of the primary objects of the invention is the provision of a new and improved brassiere construction which is comfortable and effective for properly supporting and shaping the breasts of the wearer.

Another object of the invention is a brassiere construction wherein adjacent inner portions of the cups are attached to a ring element in a manner permitting relative angular positions between the cups to more accurately conform to the physique of the wearer.

A further object of the invention is a brassiere construction wherein each cup incorporates a petal shaped opening which opens as tissue demands to conform to the wearer.

Other objects and advantages of the invention will become apparent when considered in view of the following detailed description.

IN THE DRAWING

DETAILED DESCRIPTION OF THE INVENTION

Figure 1:
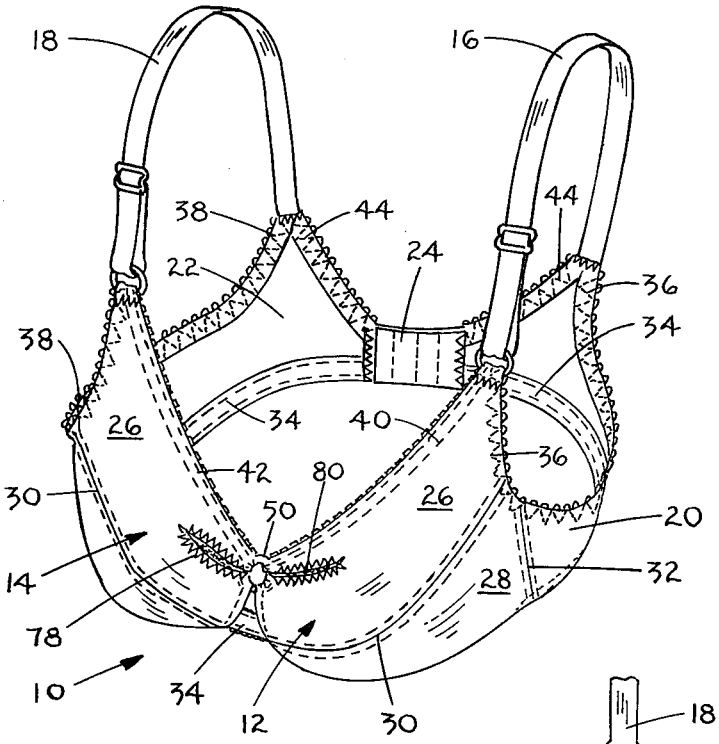
FIG. 1 is a perspective view of a brassiere embodying the invention.
Figure 2:
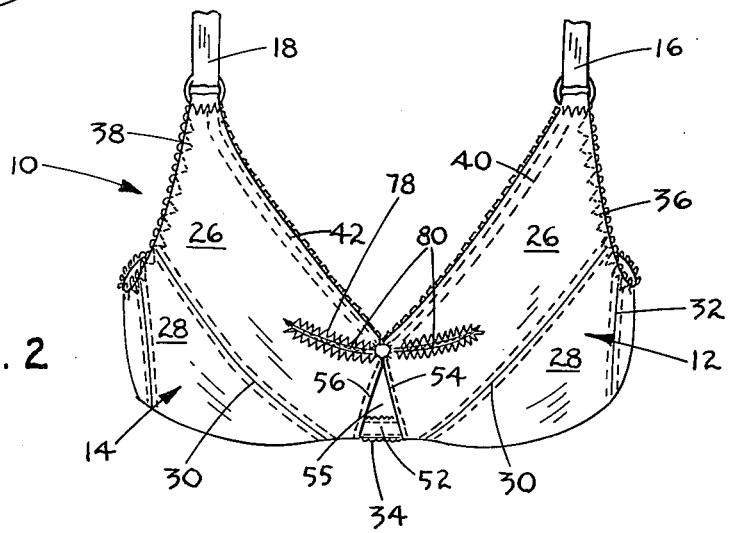
FIG. 2 is a front elevational view of the brassiere of FIG. 1.
Figure 3:
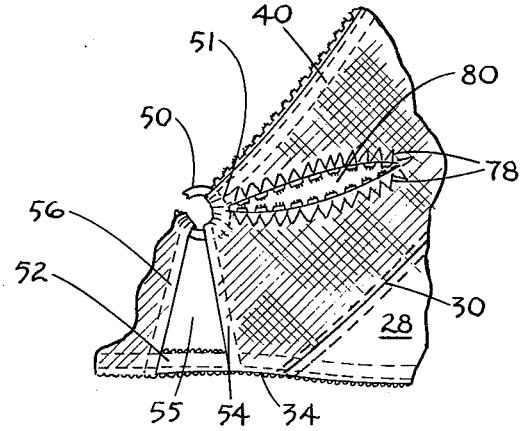
FIG. 3 is an enlarged fragmentary view of a portion of the brassiere illustrating the manner in which a cup panel, having selected portions removed, is attached to a connecting element located between the cups.

Referring now to the drawings, numeral 10 designates the brassiere of the present invention which is provided with breast cups 12, 14, a pair of shoulder straps 16, 18 which extend over the shoulders of a wearer in a conventional manner, and back bands 20, 22. The cups 12, 14 are connected to the back bands 20, 22 as is customary. The back bands carry suitable connecting elements as indicated at 24.

Each cup includes upper and lower panels 26, 28 stitched together along a seam 30 and so constructed to impart the requisite shape to the cups. The outer end portion of each panel 28 is stitched along line 32 to a back band 20 or 22. An elastic band or tape 34 extends along and is secured to the lower marginal edges of the back bands 20, 22 and cups 12, 14, as shown. Elastic bindings 36 and 38 are secured to the outer marginal edges of panels 26 and the upper marginal edges of back bands 20 and 22 and terminate adjacent the ends of shoulder straps 16 and 18. Band members 40, 42 are secured to the upper edges of panels 26. Short lengths of elastic band 44, 44 also extend from the connecting elements 24 to the ends of straps 16, 18.

The adjacent inner portions 54, 56 of cups 12 and 14 are not secured together by stitching but by a connecting means 50 and a central section 52 of elastic band 34. The connecting means 50 preferably consists of a ring-like element adapted to have the cups 12, 14 secured thereto by looping portions of the inner marginal edges of cup panels 26 through the ring 50 and stitching along lines 51. From the connector element 50, the inner portions 54, 56 of the cup panels diverge away from each other and the lower, spaced portions are sewn to band 34, thus defining a generally triangular shaped opening 55 between cups 12, 14 and the band central section 52. Each upper panel 26 is provided with an elongated petal shaped opening 80 which extends longitudinally from a point adjacent connector ring 50 in a direction generally upwardly and outwardly with respect to the brassiere cup. The opening preferably is within the range 1 inch to $1\frac{3}{4}$ inches in length.

Figure 4B:
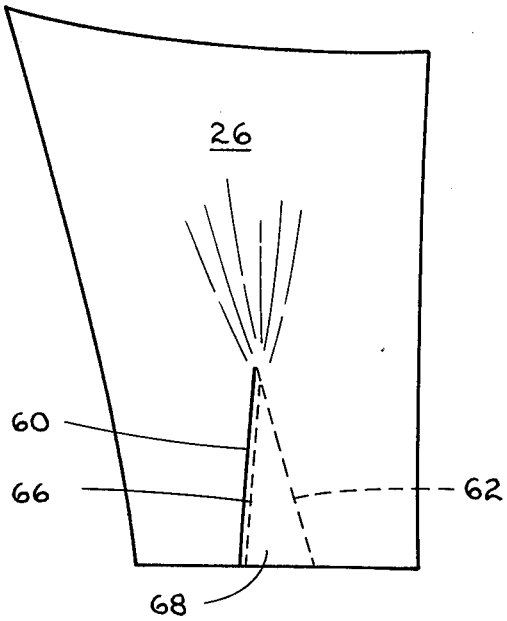
FIG. 4B is a view of the panel of FIG. 4A having a dart sewn therein.
Figure 4A:
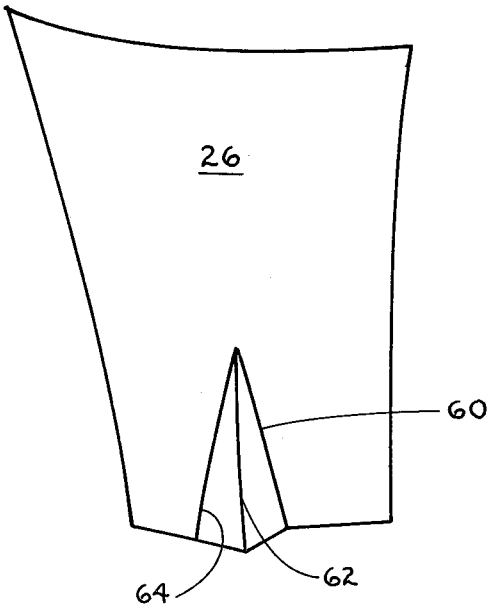
FIG. 4A is a plan view of a cup panel of a selected size illustrating fold lines for forming a dart.
Figure 4C:
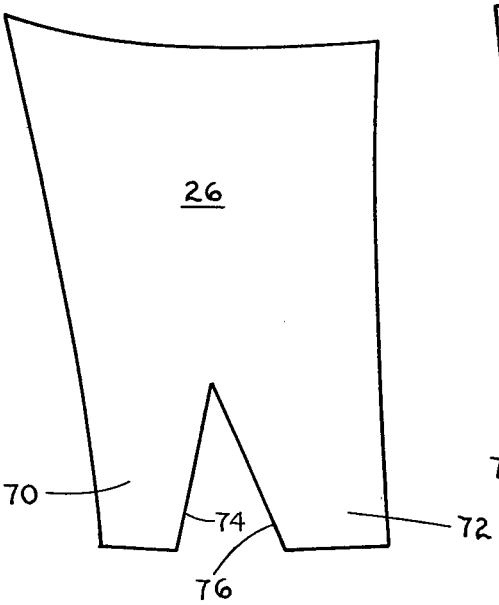
FIG. 4C is a plan view of the panel after the dart has been clipped away resulting in spaced end portions.
Figure 4D:
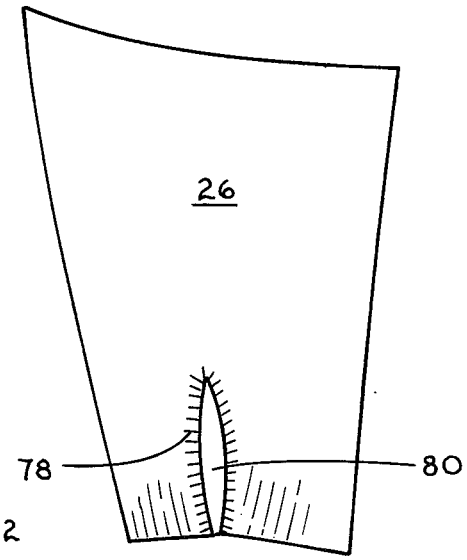
FIG. 4D is a plan view of the panel after the clipped edges of the panel have been sewn and pulled together prior to attachment to a connector element.

A panel 26 is initially cut, from a suitable piece of fabric, into a selected configuration as shown, for example, by FIG. 4A. The fabric is then folded along lines 60, 62, 64 and sewn by stitching 66 to form a dart 68. The dart, which helps to achieve cup contour, is clipped away resulting in a panel 26 as shown by FIG. 4C having end portions 70, 72 separated by severed edges 74, 76. Stitching 78 is provided around the edges 74, 76, and as the two end portions 70, 72 are positioned adjacent each other and secured to ring element 50, petal shaped opening 80 is formed.

What is claimed is:

1. A brassiere comprising a pair of breast cups, a pair of back bands connected respectively to the outer edges of the breast cups, means for releasably connecting the free ends of said back bands, shoulder strap means attached to said breast cups and to said back bands for positioning over the shoulders of a wearer, each cup including upper and lower panels of selected configurations joined together to impart a desired shape to the cups, a member secured to the upper panels of said pair of breast cups, and ring-like means intermediate said pair of cups, and attached to said upper cup panels for coupling first inner peripheral edges of said upper panel of each of said pair of cups, said member and said ring-like means being in spaced relation.

2. A brassiere as recited in claim 1, said member comprising an elastic band.

3. A brassiere as recited in claim 1, said ring-like means intermediate said pair of cups comprising a rigid element, said first inner peripheral edges of said upper panel of each of said cups being looped through and secured around said ring-like element by stitching.

4. A brassiere as recited in claim 3, each of said upper cup panels including second inner peripheral edge portions in spaced relation and cooperating with said member to define a generally triangular shaped opening.

5. A brassiere as recited in claim 4, each of said upper panels further including edge means defining an elongated, generally petal-shaped opening extending generally upwardly and outwardly from said ring-like element.

6. A brassiere comprising a pair of breast cups, a pair of back bands connected to the outer edges of said breast cups, means for releasably connecting the free ends of said back bands, coupling means intermediate said pair of breast cups for retaining said cups in a predetermined, spaced relation, said coupling means including a ring-like member, each of said cups including an upper fabric panel and a lower fabric panel, each of the upper panels having a prescribed configuration with innermost adjacent portions consisting of two discrete, separated end sections defining a space therebetween, means attaching said discrete end sections in looped relation through said ring-like member to define an elongated petal-shaped opening in each cup upper panel, each opening extending upwardly and outwardly from said ring-like member.

7. A brassiere as recited in claim 6, said coupling means further including an elongated member positioned in spaced relation below said ring-like member and secured to the inner marginal edges of said upper panel of each of said pair of cups.

* * * * *